US008960470B2

(12) United States Patent
Tarble et al.

(10) Patent No.: US 8,960,470 B2
(45) Date of Patent: Feb. 24, 2015

(54) NESTING COOLERS

(76) Inventors: Carol Tarble, North Hutchinson Island, FL (US); Michael Tarble, North Hutchinson Island, FL (US)

( * ) Notice: Subject to any disclaimer, the term of this patent is extended or adjusted under 35 U.S.C. 154(b) by 0 days.

(21) Appl. No.: 13/105,617

(22) Filed: May 11, 2011

(65) Prior Publication Data

US 2012/0285955 A1 Nov. 15, 2012

(51) Int. Cl.
*B65D 77/04* (2006.01)
*B65D 81/38* (2006.01)

(52) U.S. Cl.
CPC ..... *B65D 77/0453* (2013.01); *B65D 81/3816* (2013.01); *B65D 81/3827* (2013.01)
USPC ..... 220/23.88; 220/23.87; 206/507; 206/541; 62/457.7

(58) Field of Classification Search
CPC ..... F25D 3/08; F25D 2331/804; A45C 11/20; A47G 19/23; B65D 77/0453; B65D 77/0446; B65D 77/04; B65D 2577/042; B65D 2577/041; B65D 21/0233; B65D 21/02; B65D 21/04
USPC ..... 220/505, 507, 23.89, 23.88, 23.87, 220/23.86, 915.2, 915.1, 592.14; 206/507, 206/506, 505, 516, 515, 541, 223, 216, 206/547; 62/457.7, 457.1
IPC ..... B65D 21/04, 21/02
See application file for complete search history.

(56) References Cited

U.S. PATENT DOCUMENTS

| | | | | | |
|---|---|---|---|---|---|
| 109,739 | A | * | 11/1870 | Huntly | 229/120.01 |
| 450,527 | A | * | 4/1891 | Poyner | 206/547 |
| 1,376,770 | A | * | 5/1921 | Hunt | 229/103.11 |
| 1,463,516 | A | * | 7/1923 | McColl | 220/23.88 |
| 1,480,827 | A | * | 1/1924 | McColl | 220/592.14 |
| 2,575,770 | A | * | 11/1951 | Roop | 206/514 |
| 2,647,653 | A | * | 8/1953 | Dube | 220/592.2 |
| 3,791,547 | A | * | 2/1974 | Branscum | 220/592.2 |
| 4,483,317 | A | * | 11/1984 | Masters | 126/375.1 |
| 5,184,745 | A | * | 2/1993 | Havens et al. | 220/23.83 |
| 2005/0263527 | A1 | * | 12/2005 | Maldonado et al. | 220/592.2 |
| 2008/0022712 | A1 | * | 1/2008 | Carr | 62/425 |
| 2009/0301990 | A1 | * | 12/2009 | Cresswell et al. | 215/344 |
| 2011/0226003 | A1 | * | 9/2011 | Chaney et al. | 62/457.7 |

FOREIGN PATENT DOCUMENTS

| | | | | | |
|---|---|---|---|---|---|
| CN | 201710014 | U | * | 1/2011 | A47G 19/23 |
| FR | 590794 | A | * | 6/1925 | B65D 21/02 |

* cited by examiner

*Primary Examiner* — Robert J Hicks

(57) ABSTRACT

A compact, organized, space-saving storage design for multiple coolers allows each smaller cooler in a set of coolers fitting into the next larger cooler. The lid of each of the next larger coolers may be capable of fully closing and the smaller cooler may fit completely inside the larger cooler. The nesting coolers may improve the use of storage space, omit risk of falling over, reduce stress and organize all coolers in one easily located place.

12 Claims, 3 Drawing Sheets

NESTING COOLERS

BACKGROUND OF THE INVENTION

The present invention relates to insulated coolers and, more particularly, to a plurality of coolers that nest together and methods for storing a variety of different sized coolers safely, neatly, and organized, saving valuable space and reducing stress.

Households often own several different sized coolers for various applications. For example, one or more large coolers may be used for camping, boating and long trips. Smaller coolers may be used for short trips, keeping beverages cool or the like. To store these coolers, most often, they are stacked on top of each other, with the risk of tumbling over. Stacked coolers take up a lot of valuable storage space, causing clutter and causing stress and disorganization.

As can be seen, there is a need for a plurality of coolers that may nest together to improve the use of storage space, omit risk of falling over, reduce stress and organize all coolers in one easily located place.

SUMMARY OF THE INVENTION

In one aspect of the present invention, a set comprises a plurality of coolers, including a first cooler, a second cooler, a third cooler and a fourth cooler, wherein the fourth cooler fits inside the third cooler, third cooler fits inside the second cooler, and the second cooler fits inside the first cooler.

In another aspect of the present invention, a method for storing a plurality of coolers comprises closing a fourth cooler lid and placing the fourth cooler inside a third cooler, closing the third cooler lid and placing the third cooler inside of a second cooler; closing the second cooler lid and placing a first cooler inside the second cooler; and closing the first cooler lid.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, an embodiment of the present invention provides a compact, organized, space-saving storage design for multiple coolers. Each smaller cooler in the set of coolers may fit into the next larger cooler. The lid of each of the next larger coolers may be capable of fully closing and the smaller cooler may fit completely inside the larger cooler. The nesting coolers may improve the use of storage space, omit risk of falling over, reduce stress and organize all coolers in one easily located place.

Figure 1:
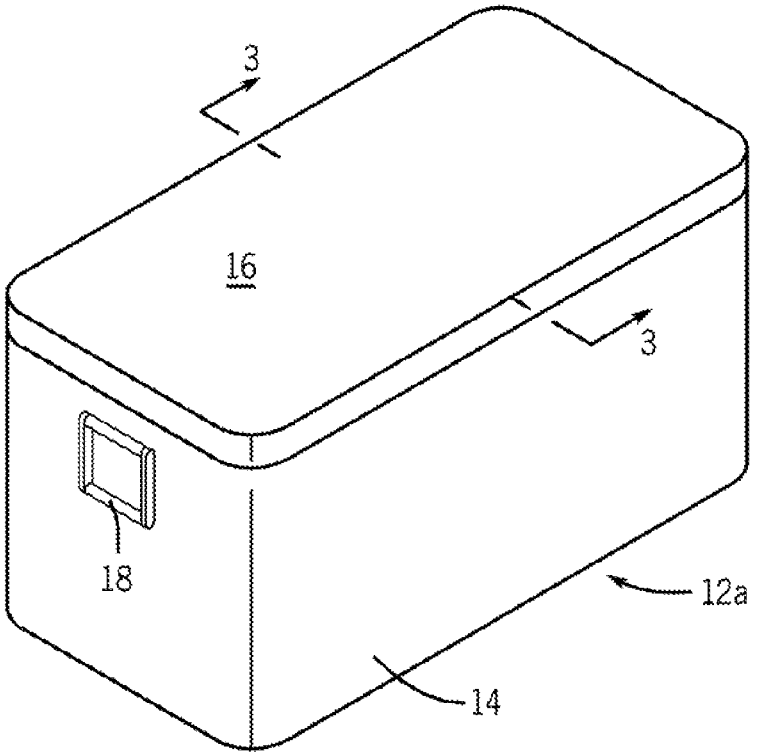
FIG. 1 is a front perspective view of a plurality of coolers nested together according to an exemplary embodiment of the present invention.
Figure 2:
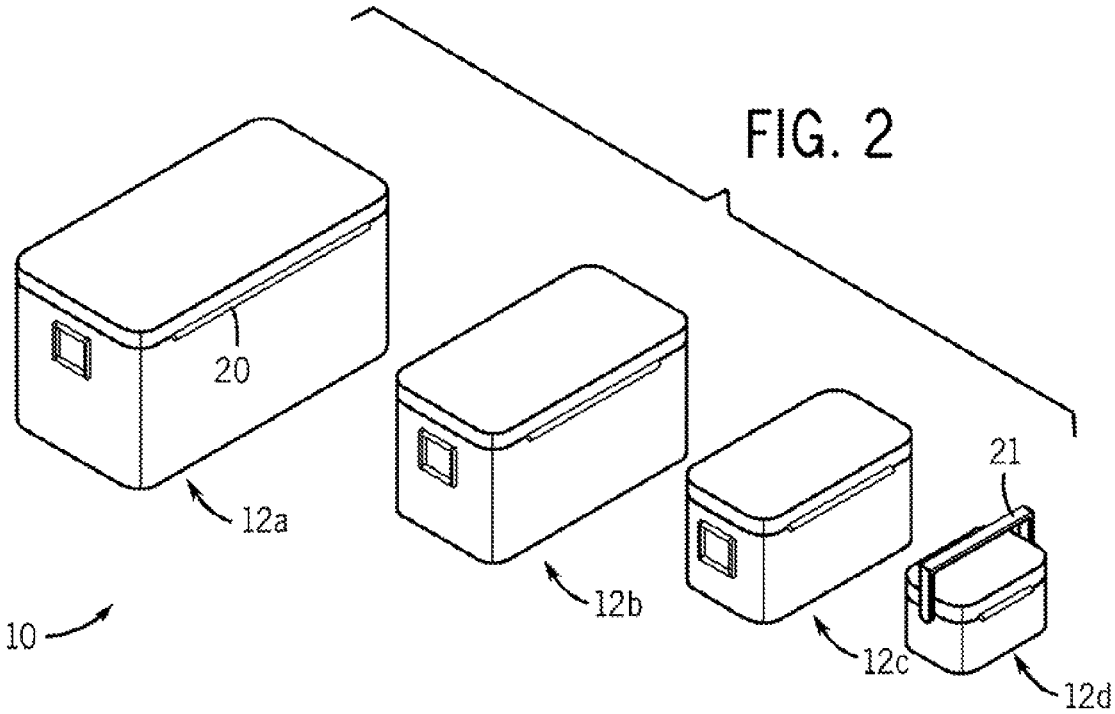
FIG. 2 is an exploded view of a set of coolers adapted to be nested together into the nested coolers shown in FIG. 1.
Figure 3:
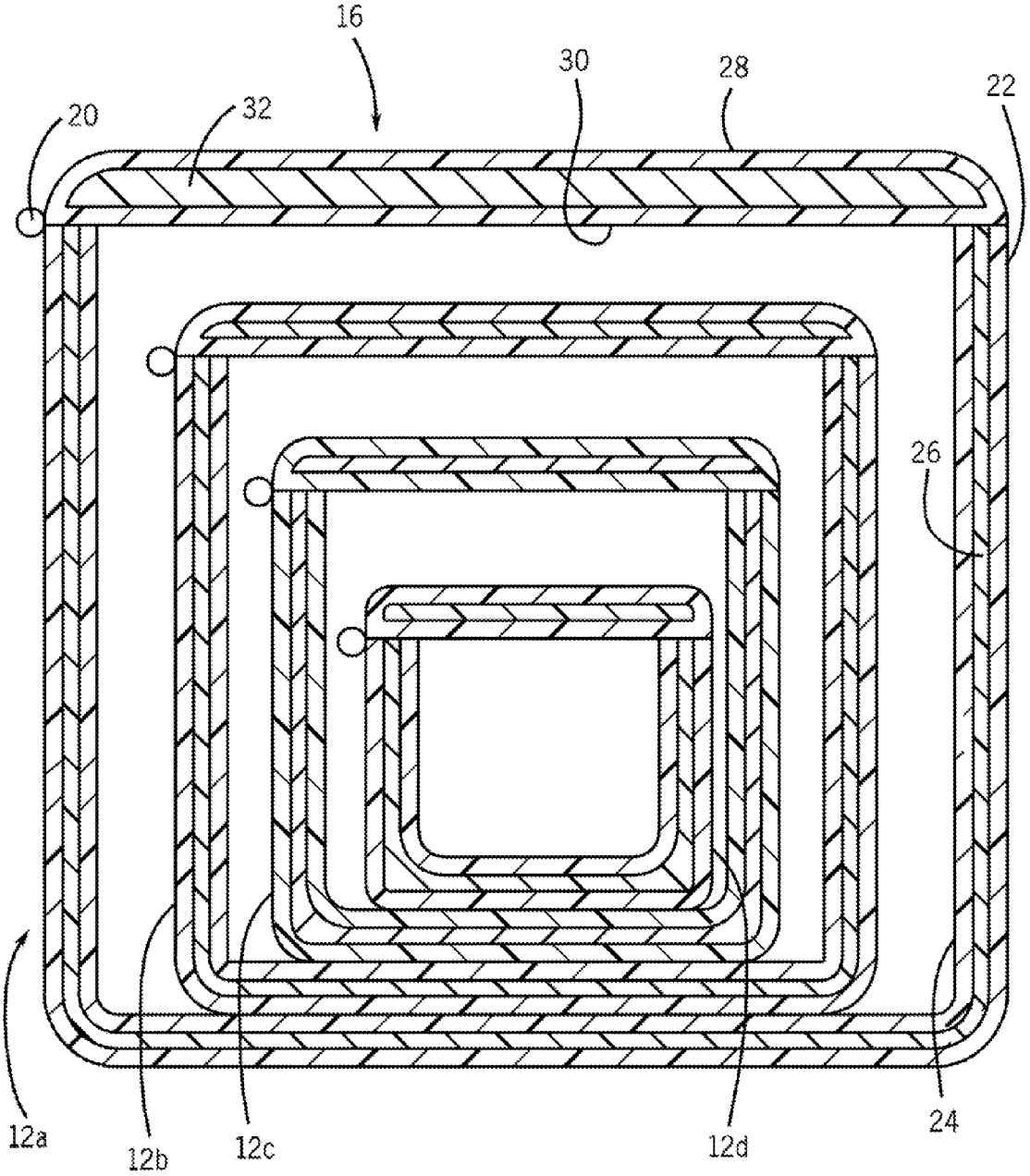
FIG. 3 is a cross-sectional view taken along line 3-3 of FIG. 1.

Referring now to FIGS. 1 through 3, a nesting cooler set 10 may include a first cooler 12*a*, a smaller second cooler 12*b*, a smaller third cooler 12*c* and an even smaller cooler 12*d*. Each of the coolers 12*a*, 12*b*, 12*c* may include a chest portion 14, a lid portion 16, handles 18 on opposite sides of the chest portion 14, and a hinge 20 for connecting the lid portion 16 to the chest portion 14. The cooler 12*d* may be the smallest cooler and may have a tote handle 21 that pivots from next to the chest portion 14 of the cooler 12*d* to over the lid 16 of the cooler 12*d*.

The chest portion 14 of each cooler 12*a*, 12*b*, 12*c*, 12*d* may include an outer casing 22 and an inner casing 24, with insulation 26 positioned therebetween. Similarly, the lid portion 16 may include an outer lid casing 28 and an inner lid casing 30 with insulation 32 positioned therebetween. Typically, the coolers 12*a*, 12*b*, 12*c*, 12*d* may be made of roto-molded ultra-high molecular weight (UHMW) polyethylene and Styrofoam insulation.

The cooler 12*d* may be a personal, or six-pack/lunch-box sized cooler, typically about 8.5 inches high, about 11.5 inches long and about 9.5 inches wide. These dimensions may vary so long as cooler 12*d* fits entirely within cooler 12*c*. In some embodiments, cooler 12*c* may be about 13.25 inches high, about 19 inches long and about 12.75 inches wide. These dimensions may vary so long as cooler 12*c* fits within cooler 12*b*. Cooler 12*b* may be about 16.5 inches high, about 24.5 inches long and about 15.75 inches wide. These dimensions may vary so long as cooler 12*b* fits within cooler 12*a*. Cooler 12*a* may be about 20 inches high, about 31 inches long and about 19.5 inches wide. These dimensions, too, may vary, so long as cooler 12*a* completely contains cooler 12*b* therewithin.

Figure 4:
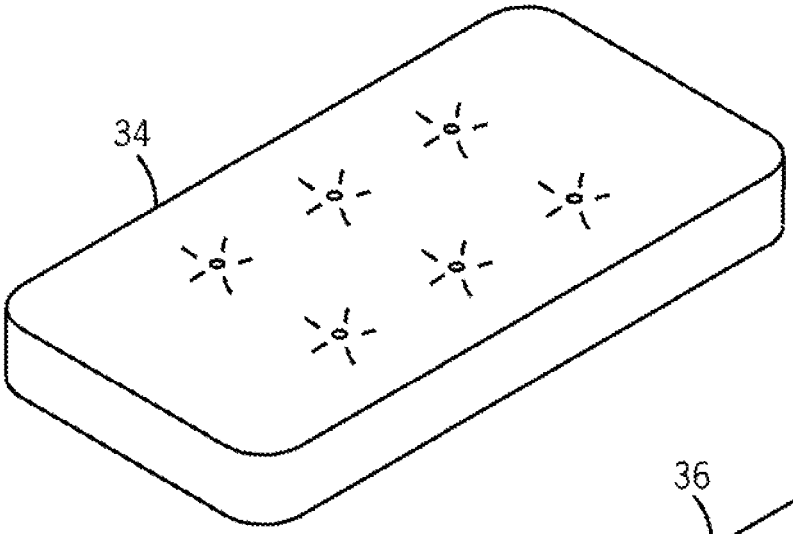
FIG. 4 is a perspective view of a seating variation usable with the nested coolers of the present invention.

Referring to FIG. 4, one of the lids 16 of the coolers 12*a*, 12*b*, 12*c*, typically the lid 16 of cooler 12*a*, may be replaced with a lid 34 that may provide a cushioned sitting area on top of the cooler 12*a*. Lid 34 may replace lid 16, or, in some embodiments, lid 34 may attach on top of lid 16.

Figure 5:
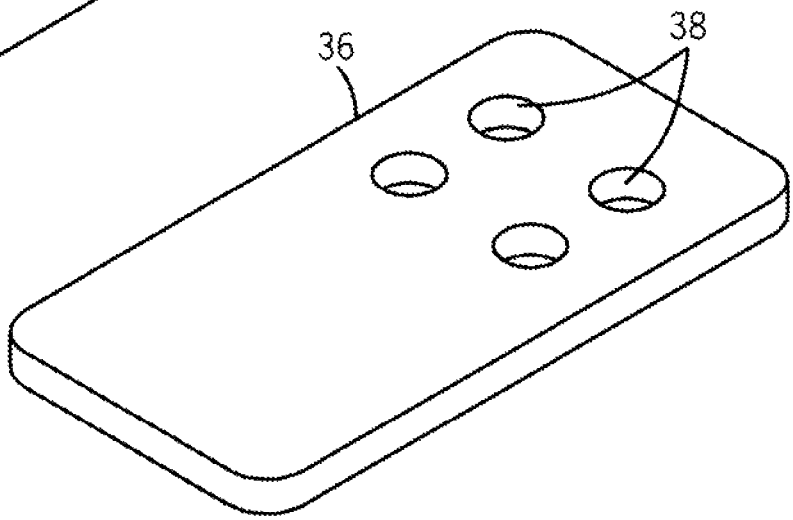
FIG. 5 is a perspective view of a cup holder accessory usable with the nested coolers of the present invention.

Referring to FIG. 5, one of the lids 16 of the coolers 12*a*, 12*b*, 12*c*, typically the lid 16 of cooler 12*a*, may be replaced with a lid 36 that may provide one or more cup holder indents 38 that may hold a cup, can, bottle or the like. Lid 36 may replace lid 16, or, in some embodiments, lid 36 may attach on top of lid 16.

The coolers 12*a*, 12*b*, 12*c*, 12*d* may be made similar to conventional coolers, for example, the coolers may be molded from UHMW polyethylene food grade plastic for the interior and exterior surfaces that may be filled with an insulation, such as Styrofoam insulation. The lids 16, 34, 36 may be attached to the chest portion 14 with molded plastic hinges and screws. The handles 18 may be made of molded plastic and may snap in place on the sides of the chest portion 14.

The coolers 12*a*, 12*b*, 12*c*, 12*d* may be used, for example, one at a time, by selecting the appropriate size cooler and nesting the remaining coolers together until needed. When the user is finished with the selected cooler, they may wash, dry, and return the cooler to its appropriate nested position. All of the coolers in the set 10 may be stored in a space no larger than the largest cooler 12*a*.

The cooler 12*d* may fit inside of cooler 12*c* and the lid of cooler 12*c* may close entirely. In some embodiments, the lid of cooler 12*c* may be kept open by a portion to provide air circulation to cooler 12*d*. With the lid of cooler 12*c* open, the cooler 12*c* may still fit within the cooler 12*b* and the lid of cooler 12*b* may close entirely, or may remain open a small amount to provide air circulation to coolers 12*c* and 12*b*. With the lid of cooler 12*b* open, the cooler 12*b* may still fit within the cooler 12*a* and the lid of cooler 12*a* may close entirely or remain open a small amount to provide air circulation to coolers 12*b*, 12*c* and 12*d*.

While the above description describes a set 10 having four nesting coolers, the set 10 may include a different number of coolers, provided that all the coolers nest together in a space no greater than the largest cooler of the set. For example, three coolers may nest together to form the set. Likewise, 5 or more coolers may nest together to form the set.

It should be understood, of course, that the foregoing relates to exemplary embodiments of the invention and that modifications may be made without departing from the spirit and scope of the invention as set forth in the following claims.

We claim:

1. A set comprising:

a plurality of coolers, including a first cooler, a second cooler, a third cooler and a fourth cooler, each of the plurality of coolers having an outer casing and an inner casing with insulation positioned therebetween, at least the first cooler, the second cooler and the third cooler each includes a chest portion having a lid portion hingedly attached thereto, wherein the fourth cooler fits inside the third cooler with a fourth cooler bottom portion outer casing resting entirely against a third cooler bottom portion inner casing, the third cooler fits inside the second cooler with a third cooler bottom portion outer casing resting entirely against a second cooler bottom portion inner casing, and the second cooler fits inside the first cooler with a second cooler bottom portion outer casing resting entirely against a first cooler bottom portion inner casing;

the fourth cooler is a lunch-box cooler with a tote handle; and the plurality of coolers have a rectangular shape.

2. The set of claim 1, wherein at least the first cooler and the second cooler have handles at opposite sides thereof.

3. The set of claim 1, wherein the lid portion of at least one of the coolers includes a cushioned seating surface.

4. The set of claim 3, wherein the cushioned seating surface forms the lid portion of the first cooler.

5. The set of claim 1, wherein the lid portion of at least one of the coolers includes at least one cup holder indent.

6. The set of claim 5, wherein the at least one cup holder indent is disposed in the lid portion of the first cooler.

7. A method for storing a plurality of coolers, comprising:

closing a fourth cooler with a fourth lid and placing the fourth cooler completely inside a third chest portion of a third cooler, wherein the fourth cooler is a lunch-box cooler with a tote handle;

closing the third cooler with a third hinged lid and placing the third cooler completely inside a second chest portion of a second cooler;

closing the second cooler with a second hinged lid and placing the second cooler completely inside a first chest portion of a first cooler; and closing the first cooler with a first hinged lid, wherein each of the plurality of coolers having an outer casing and an inner casing with insulation positioned therebetween;

each of the plurality of coolers have a rectangular shape; and the fourth cooler fits inside the third cooler with a fourth cooler bottom portion outer casing resting entirely against a third cooler bottom portion inner casing, the third cooler fits inside the second cooler with a third cooler bottom portion outer casing resting entirely against a second cooler bottom portion inner casing, and the second cooler fits inside the first cooler with a second cooler bottom portion outer casing resting entirely against a first cooler bottom portion inner casing.

8. The method of claim 7, wherein a lid portion of at least one of the coolers includes a cushioned seating surface.

9. The method of claim 8, wherein the cushioned seating surface forms the lid portion of the first cooler.

10. The set of claim 1, wherein the inner casing and the outer casing is made of a food grade plastic and the insulation is foam insulation.

11. The set of claim 1, wherein the tote handle of the fourth cooler is pivotably movable from next to the chest portion of the fourth cooler to over the lid of the fourth cooler.

12. The set of claim 1, wherein a bottom portion of each of the second, third and fourth coolers rest against an inside portion of each of the first, second and third coolers, respectively.

* * * * *